US009578976B2

(12) United States Patent
Grubbs et al.

(10) Patent No.: US 9,578,976 B2
(45) Date of Patent: Feb. 28, 2017

(54) ADJUSTABLE MOUNTING STRUCTURE FOR A SHELVING SYSTEM

(71) Applicants: Matthew Grubbs, Union, KY (US); Gregory M. Bird, Solon, OH (US)

(72) Inventors: Matthew Grubbs, Union, KY (US); Gregory M. Bird, Solon, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 500 days.

(21) Appl. No.: 13/957,986

(22) Filed: Aug. 2, 2013

(65) Prior Publication Data

US 2014/0034591 A1 Feb. 6, 2014

Related U.S. Application Data

(60) Provisional application No. 61/679,419, filed on Aug. 3, 2012, provisional application No. 61/808,010, filed on Apr. 3, 2013.

(51) Int. Cl.

| | |
|---|---|
| ***A47F 1/04*** | (2006.01) |
| ***A47B 96/02*** | (2006.01) |
| ***A47B 96/06*** | (2006.01) |
| *A47F 1/12* | (2006.01) |

(Continued)

(52) U.S. Cl.

CPC ..... *A47F 1/04* (2013.01); *A47B 96/028* (2013.01); *A47B 96/068* (2013.01); *A47F 1/12* (2013.01); *A47F 5/005* (2013.01); *A47F 5/0093* (2013.01); *A47F 5/103* (2013.01)

(58) Field of Classification Search

CPC ..... A47F 5/0093; A47F 5/005; A47F 5/0043; A47F 5/101; A47F 5/103; A47F 5/0081; A47F 1/125; A47F 1/126; A47F 1/12; A47F 1/04; A47B 57/045; A47B 57/16; A47B 57/42; A47B 57/425; A47B 96/025;

(Continued)

(56) References Cited

U.S. PATENT DOCUMENTS 3,463,433 A * 8/1969 Coe ..... A47B 57/045 108/108
4,098,480 A * 7/1978 Neumann ..... A47B 96/028 211/153

(Continued)

FOREIGN PATENT DOCUMENTS

CA 2 725 928 A1 6/2011

OTHER PUBLICATIONS

FFR-DSI Yellow Pages 2010 Product Catalog, cover pages, pp. 231, 241 and 246.

*Primary Examiner* — Patrick Hawn
(74) *Attorney, Agent, or Firm* — Fay Sharpe LLP

(57) ABSTRACT

A shelf system includes a support member that accommodates an associated object for display and dispensing. The support member includes a front end and a rear end. A mounting portion is disposed adjacent the support member rear end. The mounting portion includes a first member which connects to an associated upright and a second member which is operatively connected to the support member. A pin is connected to one of the first and second members and a sleeve is connected to the other of the first and second members, wherein the sleeve selectively accommodates the pin. A fastener is provided for selectively securing the pin in the sleeve.

17 Claims, 15 Drawing Sheets

(51) Int. Cl.
*A47F 5/00* (2006.01)
*A47F 5/10* (2006.01)

(58) Field of Classification Search
CPC ..... A47B 96/027; A47B 96/02; A47B 96/028; A47B 96/06; A47B 96/061; A47B 96/068
USPC ..... 211/59.2, 59.3, 90.02; 108/108
See application file for complete search history.

(56) References Cited

U.S. PATENT DOCUMENTS 4,378,925 A * 4/1983 Griffin ..... A47B 57/045 108/108
4,589,349 A * 5/1986 Gebhardt ..... A47B 96/025 108/102
4,934,645 A * 6/1990 Breslow ..... A47B 57/045 108/108
5,390,802 A * 2/1995 Pappagallo ..... A47B 45/00 211/187
5,484,068 A * 1/1996 Huang ..... A47B 57/045 211/193
5,531,159 A * 7/1996 Stubblefield ..... A47F 5/0093 108/100
5,542,552 A 8/1996 Yablans et al.
5,673,801 A * 10/1997 Markson ..... A47F 5/005 211/184
5,720,230 A * 2/1998 Mansfield ..... A47F 5/0043 108/108
5,738,019 A * 4/1998 Parker ..... A47B 46/00 108/108
5,806,689 A 9/1998 Mays et al.
5,970,887 A * 10/1999 Hardy ..... A47B 46/00 108/108
6,021,908 A * 2/2000 Mathews ..... A47F 3/0443 211/153
6,041,720 A * 3/2000 Hardy ..... A47B 96/02 108/60
6,095,347 A * 8/2000 Mauro-Vetter ..... B65G 1/02 211/151
6,123,303 A * 9/2000 Huang ..... A47B 57/482 211/90.02
6,142,317 A 11/2000 Merl
6,234,328 B1 * 5/2001 Mason ..... A47B 57/045 211/150
6,302,282 B1 * 10/2001 Gay ..... A47B 57/045 108/152
6,357,609 B1 * 3/2002 Van Noord ..... A47B 45/00 108/65
6,513,667 B2 2/2003 Battaglia et al.
6,799,523 B1 * 10/2004 Cunha ..... A47F 5/0093 108/108
7,040,494 B2 * 5/2006 Harper ..... A47B 96/021 211/135
7,258,317 B1 * 8/2007 Nagel ..... A47B 96/025 108/108
7,641,072 B1 1/2010 Vlastakis et al.
7,690,519 B2 4/2010 Kahl et al.
7,823,734 B2 11/2010 Hardy
8,152,006 B2 4/2012 Wamsley et al.
8,413,825 B2 * 4/2013 Spizman ..... A47B 57/045 211/150
8,469,205 B1 6/2013 Hardy
8,596,443 B2 * 12/2013 Brugmann ..... A47F 5/0093 193/35 R
8,800,785 B2 * 8/2014 Kalafut ..... A47F 5/0861 211/103
9,215,938 B2 12/2015 Neumann et al.
2002/0027115 A1 * 3/2002 Gay ..... A47B 57/045 211/187
2003/0066811 A1 * 4/2003 Dimattio ..... A47F 5/005 211/59.2
2003/0160012 A1 * 8/2003 Kanouchi ..... A47F 5/0093 211/59.2
2004/0140279 A1 7/2004 Mueller et al.
2004/0182804 A1 * 9/2004 Harper ..... A47B 96/021 211/90.02
2007/0170127 A1 7/2007 Johnson
2008/0035589 A1 * 2/2008 Rasmussen ..... A47F 1/126 211/59.3
2011/0100942 A1 * 5/2011 Spizman ..... A47B 57/045 211/150
2012/0103922 A1 5/2012 Bird et al.
2012/0211327 A1 * 8/2012 Brugmann ..... A47F 5/0093 193/35 R
2014/0091696 A1 * 4/2014 Welker ..... A47F 5/0043 312/408

* cited by examiner

ADJUSTABLE MOUNTING STRUCTURE FOR A SHELVING SYSTEM

The instant application is a full utility application of and claims priority from U.S. Provisional Application Ser. No. 61/679,419 which was filed on Aug. 3, 2012 and from U.S. Provisional Application Ser. No. 61/808,010 which was filed on Apr. 3, 2013. Both of these applications are incorporated by reference in their entireties.

BACKGROUND

The present disclosure concerns a product dispensing system employed in point of sale merchandising. It particularly pertains to shelving systems which feed containers forward. More specifically, it relates to modular gravity fed shelving systems for fragile products, such as individual thin wall containers of, for example, a refrigerated dairy product.

Many products of this type are available, including yogurt, cottage cheese, cream cheese, sour cream and the like. Such products are typically sold in individual cups or containers in supermarkets and the like. Dairy product containers of this kind normally have planar bases and planar tops so that they can be stacked atop each other. Traditionally, such dairy products are sold in refrigerator cases, including generally horizontal shelves upon which the dairy products are held.

Gravity feed systems are known to move products towards the front of display or storage cases. While it is now known to feed dairy products such as yogurt by gravity towards the front end of a refrigerated display case, the currently known retainers positioned at the front end of such display trays or shelves are not optimal. In addition, conventional display shelving systems require more vertical spacing between adjacent shelves in order to allow restocking of the dairy products on the shelves because of clearance issues. Specifically, the merchant cannot allow products on a shelf which is pulled out for restocking to contact the shelf immediately above it. This mandates a minimum shelf spacing in a storage case. It is a particular problem for slide out shelving which conventionally needs to be tilted as it is slid forward to the restocking position.

Further, current shelving designs do not allow for a secondary shelf to be placed atop the primary shelf to provide additional displays of product. Such a design is useful for providing more product selection without the need to replace the entire shelving system. It would be desirable to provide an adjustable mounting structure for shelving systems so that the shelves can be accommodated in the supports or stanchion designs of several different stanchion manufacturers which each have a somewhat different design for their respective stanchions or supports. It would also be desirable to provide a better locking system for pull out shelving to retain a slide out shelf in the use position. Thus, a need exists for a shelving system which overcomes the deficiencies of prior shelving systems as outlined above.

BRIEF DESCRIPTION OF THE DISCLOSURE

In one embodiment, the present disclosure pertains to a shelf system comprising a support member that accommodates an associated object for display and dispensing with the support member including a front end and a rear end. A mounting portion is disposed adjacent the support member rear end. The mounting portion comprises a first member which connects to an associated upright and a second member which is operatively connected to the support member. A pin is connected to one of the first and second members and a sleeve is connected to the other of the first and second members, wherein the sleeve selectively accommodates the pin. A fastener is provided for selectively securing the pin in the sleeve.

In accordance with another embodiment of the present disclosure, a shelf system is provided comprising a support member that accommodates an associated object for display and dispensing with the support member including a front end, a rear end, a left edge and a right edge. A pair of mounting portions is disposed adjacent the support member rear end adjacent, respectively, the left edge and the right edge thereof. Each mounting portion comprises a first member which connects to an associated upright and a second member which is operatively connected to the support member. A pin is connected to one of the first and second members and a sleeve is connected to the other of the first and second members, wherein the sleeve selectively accommodates the pin. A fastener is provided for selectively securing the pin in the sleeve.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

It should be understood that the description and drawings herein are merely illustrative and that various modifications and changes can be made in the structures disclosed without the departing from the scope of the present disclosure. It should also be appreciated that the various identified components of the product merchandising systems discussed herein are merely terms of art and that these may vary from one manufacturer to another. Such terms should not be deemed to limit the present disclosure.

Figure 1:
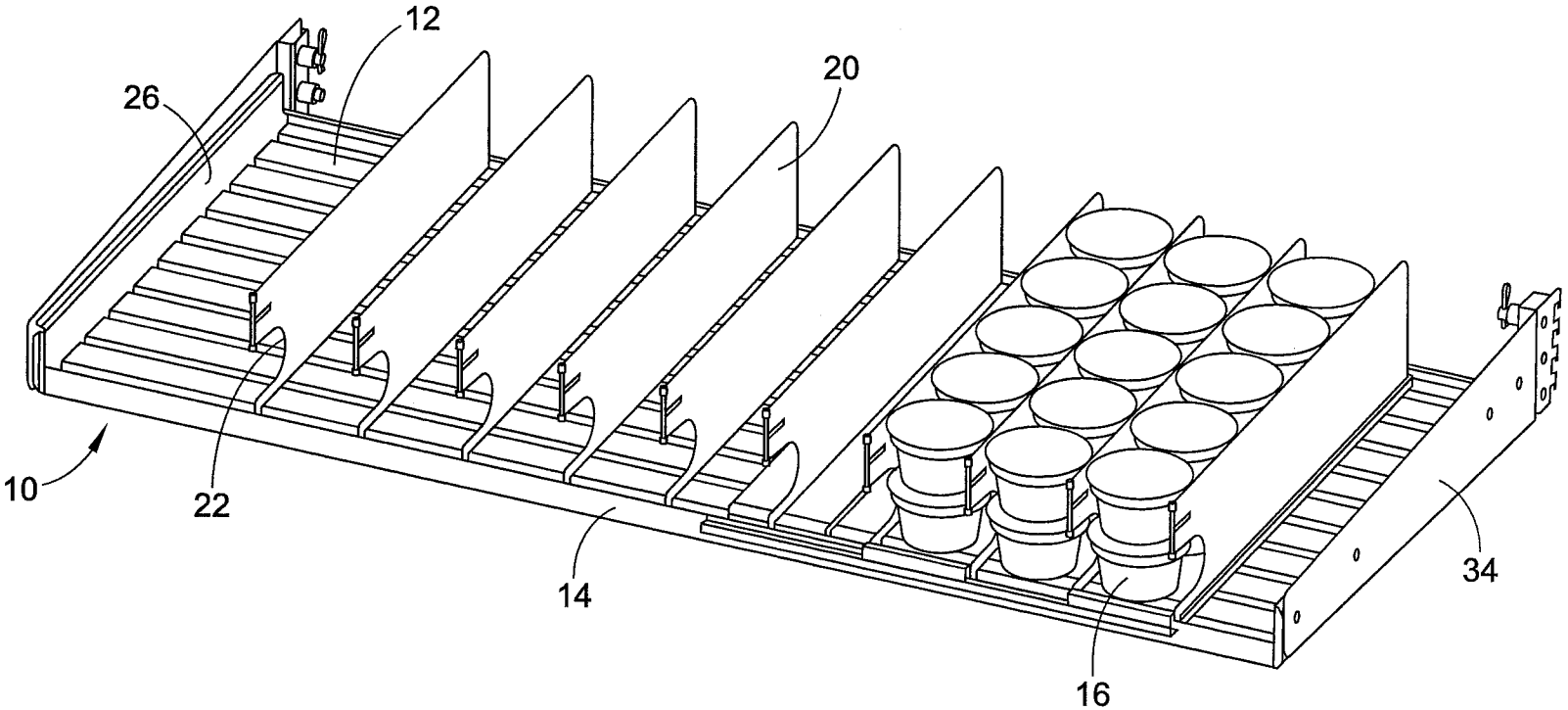
FIG. 1 is a perspective view of a shelving system according to a first embodiment of the present disclosure in a retracted position.

With reference now to FIG. 1, a first embodiment of a shelving system according to the instant disclosure includes a merchandising shelf 10. In the embodiment disclosed, the shelf includes a base 12 on which are supported a plurality of roller tracks 14. The roller tracks can be of the type disclosed in U.S. Pat. No. 6,089,385 which issued on Jul. 18, 2000 and is entitled "Roller Type Commodity Stand." The disclosure of the '385 patent is incorporated hereinto by reference in its entirety. Other means for moving the packages or containers forward on the shelf include motion mats or any known non-friction material.

Supported on the roller track 14 can be a container 16 or a stacked set of containers. The containers can be, for example, dairy product containers. It is well known that such containers can hold sour cream, cottage cheese, yogurt, cream cheese and the like. The containers generally have planar bottom and top surfaces so that they can be stacked atop each other as is illustrated in FIG. 1. A gravity fed system is illustrated in which the containers will move towards the front end of the shelf because the front end is located at a lower elevation than the rear end of the shelf. Not very visible in FIG. 1 is a front barrier which prevents the container 16 from falling off the front end of the shelf. Such a barrier can be a conventional fence, as is known in the art.

Separating the several containers 16 into columns are respective dividers 20. The dividers can be mounted either to the roller tracks 14 or directly to the shelf base 12, depending on the design of the roller tracks and of the shelf base. It should be appreciated that the dividers 20 are of sufficient height so as to divide a stacked set of containers into columns. Located at a front end of each divider is a cutout 22. The purpose for the cutout is to allow finger access by a customer in order to grasp a container which the customer wishes to remove from the shelf.

Figure 2:
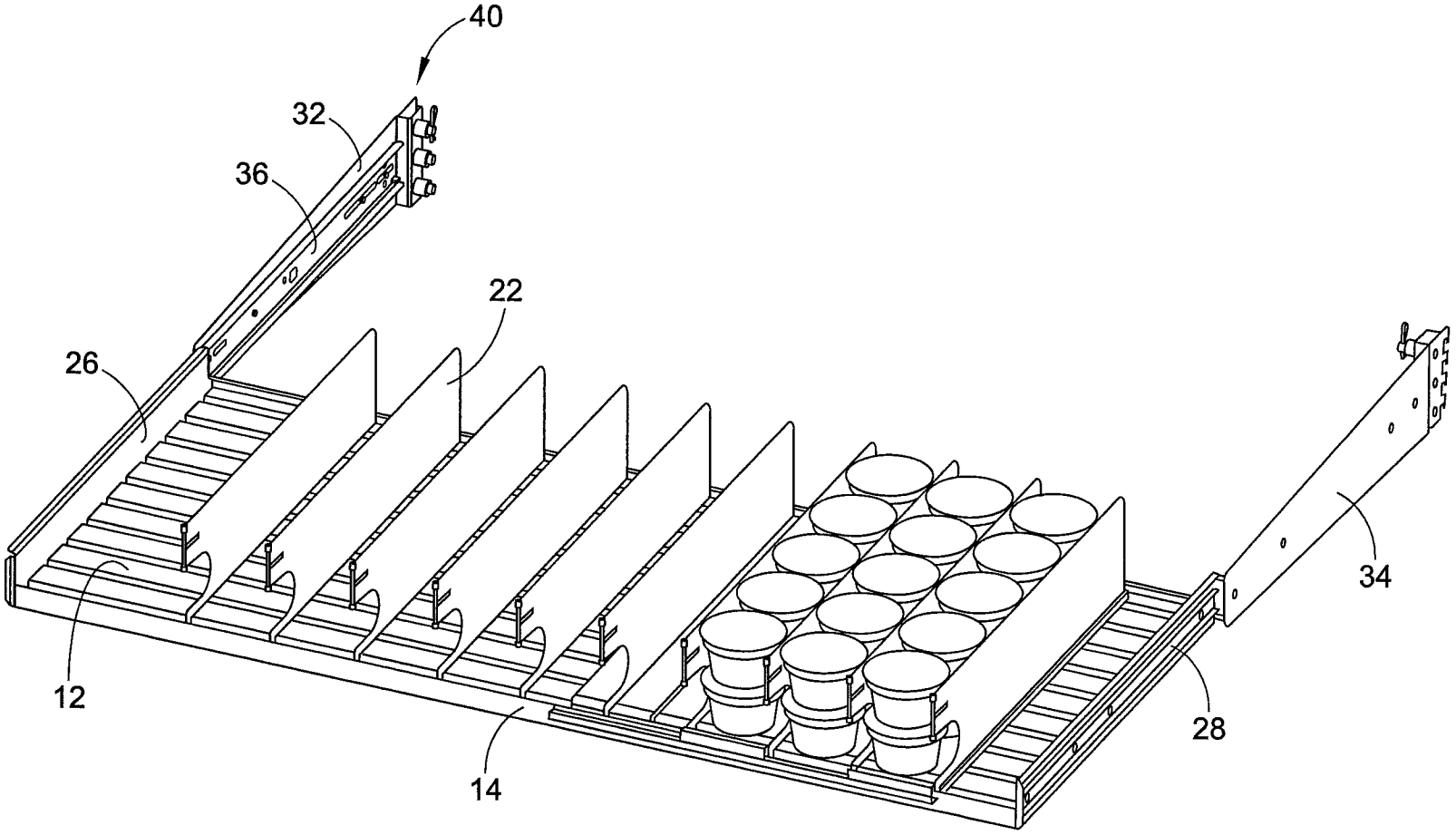
FIG. 2 is a perspective view of the shelving system of FIG. 1 shown in an extended position.
Figure 5:
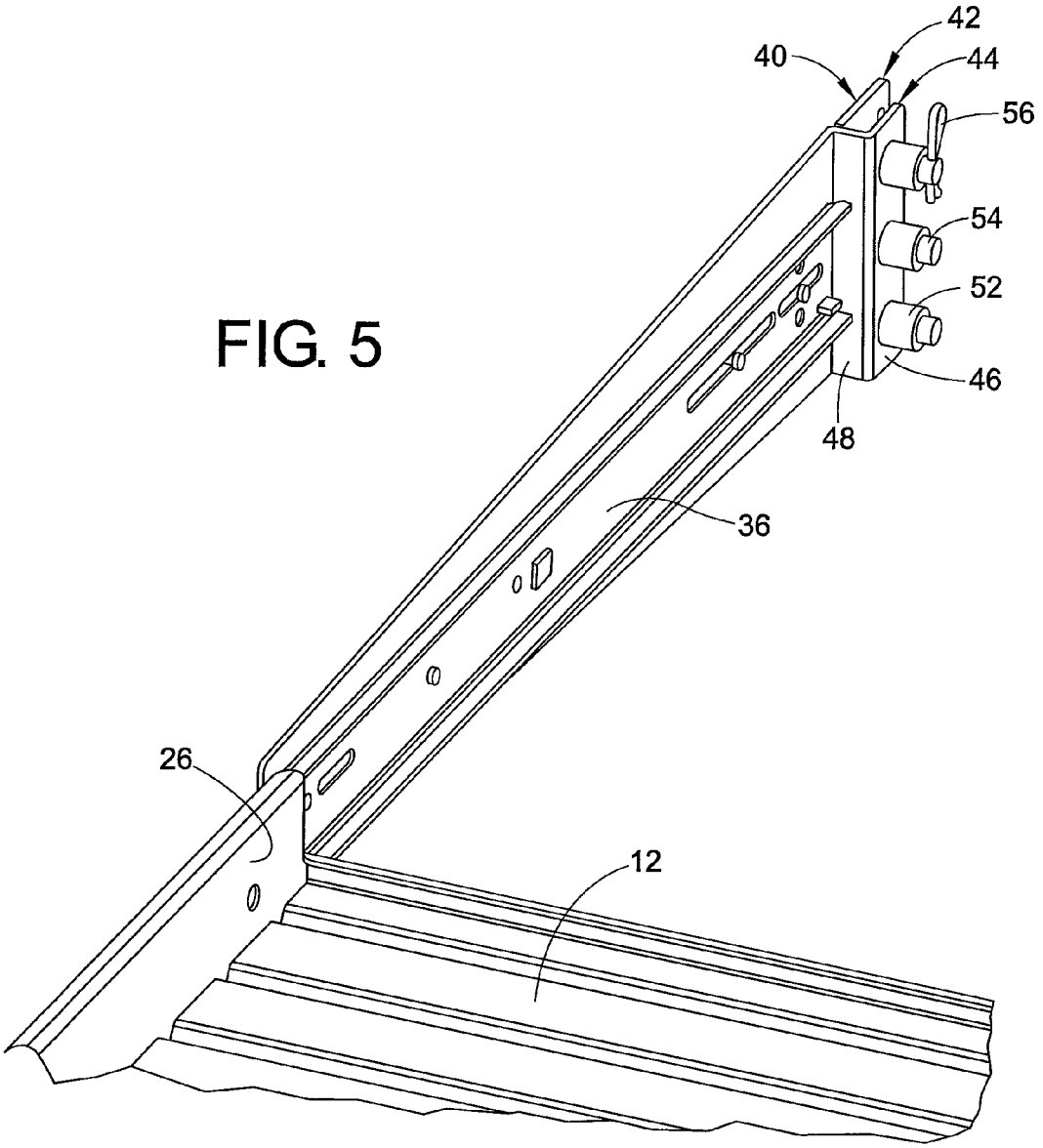
FIG. 5 is a greatly enlarged perspective view of a portion of the shelving system of FIG. 2.
Figure 12:
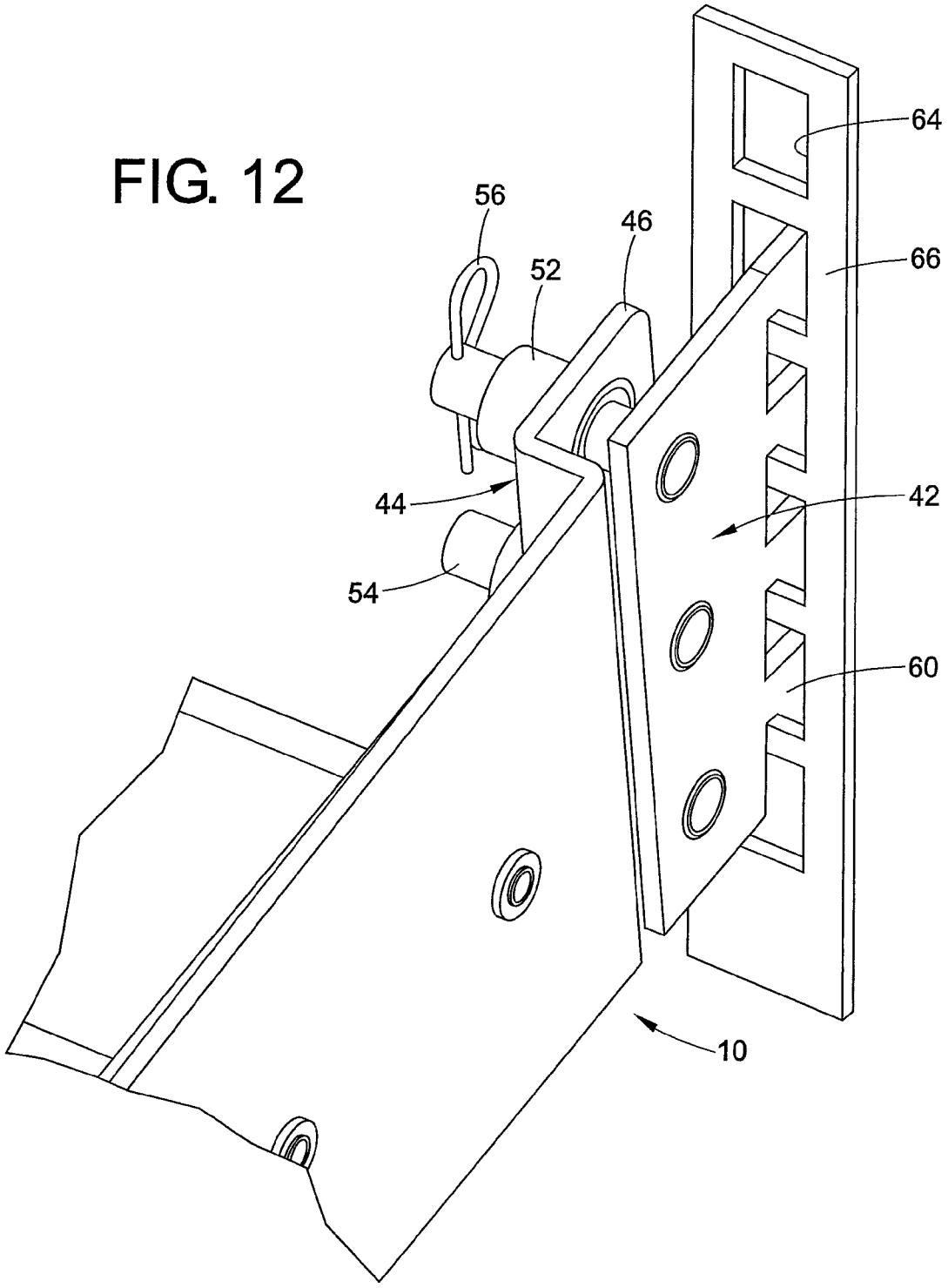
FIG. 12 is an enlarged perspective view of a mounting portion of the shelving system illustrated in FIG. 1.

With reference now also to FIG. 2, it can be appreciated that the shelf 10 is of a pull out nature. To this end, the shelf includes a pair of side walls 26 and 28 attached or connected to the base wall 12. The shelf, via the side walls 26 and 28, is slidably mounted in respective first and second brackets 32 and 34 of the shelving assembly. To this end, respective slides 36 (only one of which is visible in FIG. 2) are provided. Located at a rear end of the respective brackets is a mounting portion 40. Since the two mounting portions are mirror images of each other, only one of the mounting portions will be discussed in detail herein. With reference now to FIGS. 5 and 12, the mounting portion 40 includes a first member 42 and spaced therefrom and extending generally parallel thereto a second member 44. The second member 44 is integral with the bracket and includes a first wall 46 as well as a connecting wall 48 for connecting the first wall to the remainder of the bracket. A somewhat L-shaped design is disclosed for the second member. Mounted on the first wall 46 is at least one sleeve 52. In this embodiment, three such sleeves are shown in a vertically spaced alignment. Slidably mounted in each sleeve 52 is a pin or connecting member 54 which is fastened to the first member 42. Extending through the pin 54 is an aperture (not visible) which can selectively accommodate a cotter pin 56 to hold the pin in place in the sleeve 52.

Figure 8:
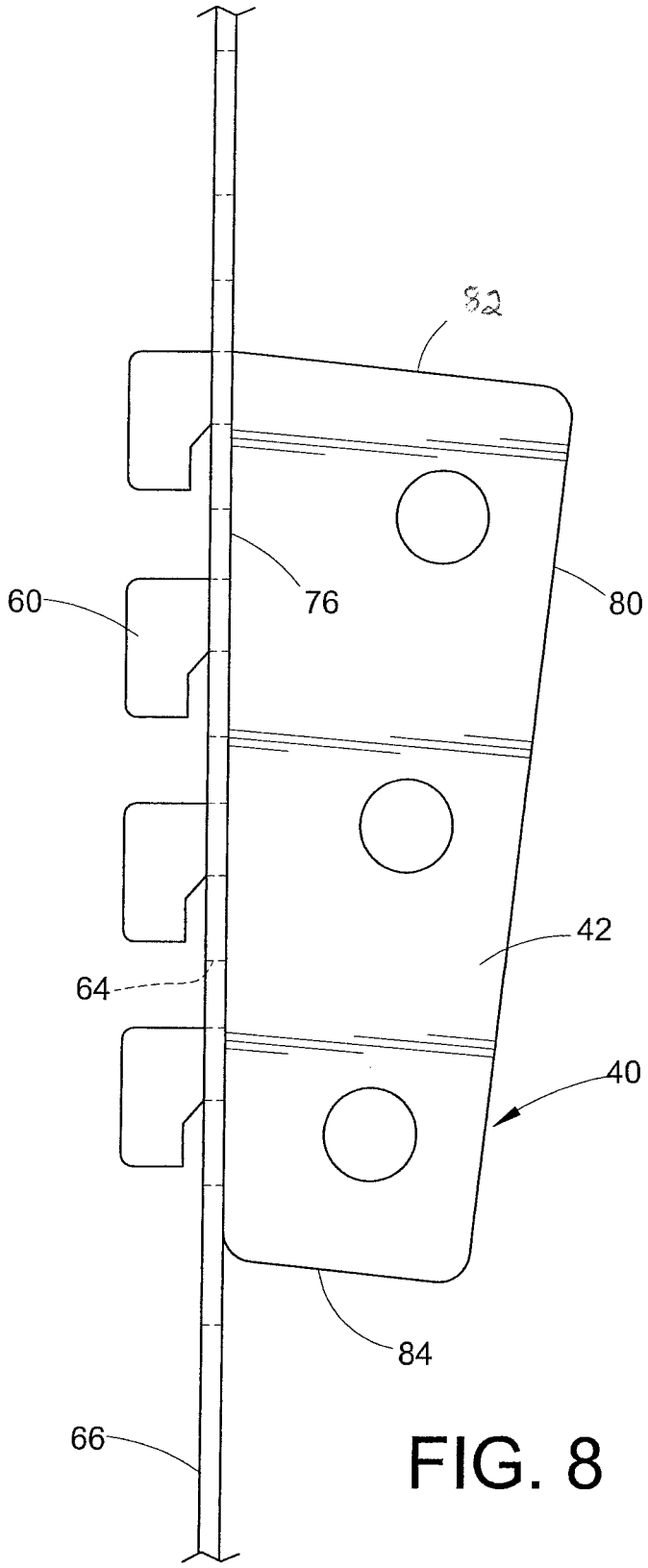
FIG. 8 is a greatly enlarged side elevational view of a bracket of the shelving system of FIG. 1 as mounted on a support.
Figure 9:
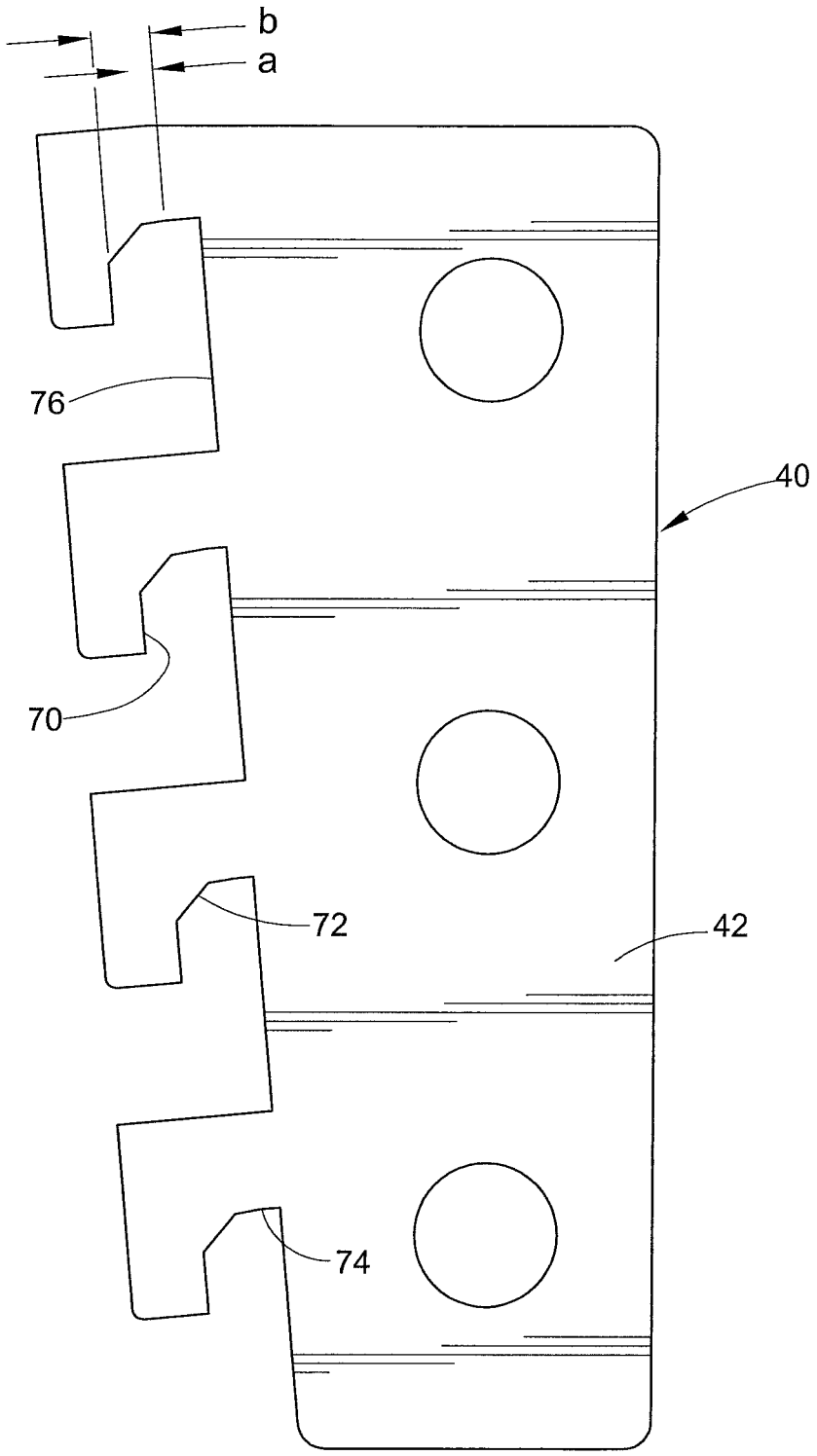
FIG. 9 is an enlarged side elevational view of a bracket of FIG. 8.

With reference now to FIG. 8, the mounting portion 40 includes a plurality of vertically spaced teeth 60 which are designed to protrude through respective apertures 64 defined in a support, standard or stanchion 66 as is well known in the art. There are a number of support manufacturers which each have a somewhat different design for their respective supports. With reference now to FIG. 9, the instant mounting portion is meant to accommodate the support or stanchion designs of several such manufacturers. To this end, the plurality of teeth 60 each include a first wall section 70, a second wall section 72 and a third wall section 74. The wall sections are so oriented that the first section 70 extends generally vertically and is aligned with and spaced from a rear wall 76 of the mounting portion. The second section 72 is oriented at an angle of approximately 45 degrees to the orientation of the first wall section 70. The third wall section 74 is oriented generally perpendicular to the first wall section 70. In this way, a support material width of a (about 0.08 inches) is accommodated by the third wall section 74, whereas a width of b (about 0.180 inches) can be accommodated between the first wall section 70 and the rear wall of the bracket 76. Thus, varying thicknesses of material in the supports or stanchions of the several manufacturers can be accommodated by the mounting portion 40 disclosed herein.

With this arrangement, and with reference again to FIG. 12, the first member 42 can be mounted to the support or standard 66 and the shelf 10 is slid onto the first member 42 via the interengagement of the several pins 54 with the sleeves 52. The shelf is held in place on the first member by use of the cotter pins 56. In one embodiment, three sleeves 52 and three pins 54 are employed. Of course, a variety of other designs is also contemplated.

Figure 10:
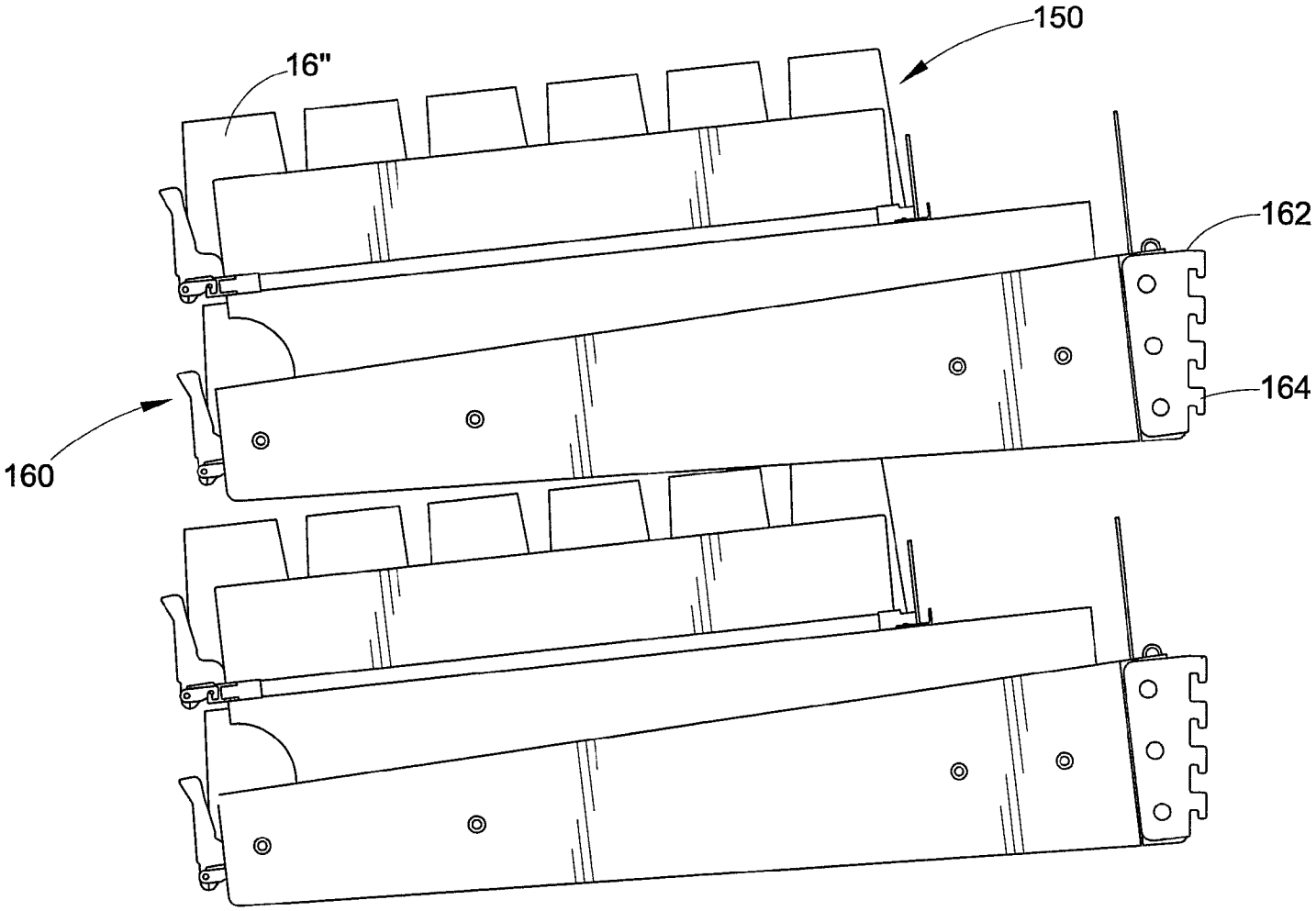
FIG. 10 is a side elevational view of a shelving system employing the second embodiment illustrated in FIG. 3.

With reference now again to FIG. 8, in addition to the back wall 76, the mounting portion also includes a front wall 80, a top wall 82 and a bottom wall 84. It can be seen that the top wall 82 is wider than is the bottom wall 84 so that the mounting portion 40 is angled downwardly somewhat in relation to a horizontal plane. As a result, so is the shelf attached to the mounting portion. As best seen in FIG. 10, the shelving arrangement angles downwardly so as to provide a gravity feed to the containers held on the shelf.

The stanchions of various manufacturers, such as Hussman, Hill-Phoenix and Kysor-Warren vary somewhat, not only in the thickness of the metal used in the supports or stanchions or uprights, but also in the longitudinal spacing between an adjacent pair of such supports to which a shelf is mounted. In order to accommodate such spacing variations, the instant shelving assembly provides a design in which the mounting portion 40 includes the first member 42 which holds the several pins 54 and a second member 44 defined by the wall sections 46 and 48, which hold the sleeves or collars 52 held on the wall section 46. As best seen in FIG. 12, the pins 54 protrude through the sleeves 52 and are held in place via the cotter pins 56. See also FIG. 5. Variations in the spacing between adjacent supports can be accommodated by suitable movement of the second member 44 in relation to the first member 42. The shelf 10 can thus be employed with the supports of a variety of manufacturers making the disclosed shelf design nearly universal.

Figure 6:
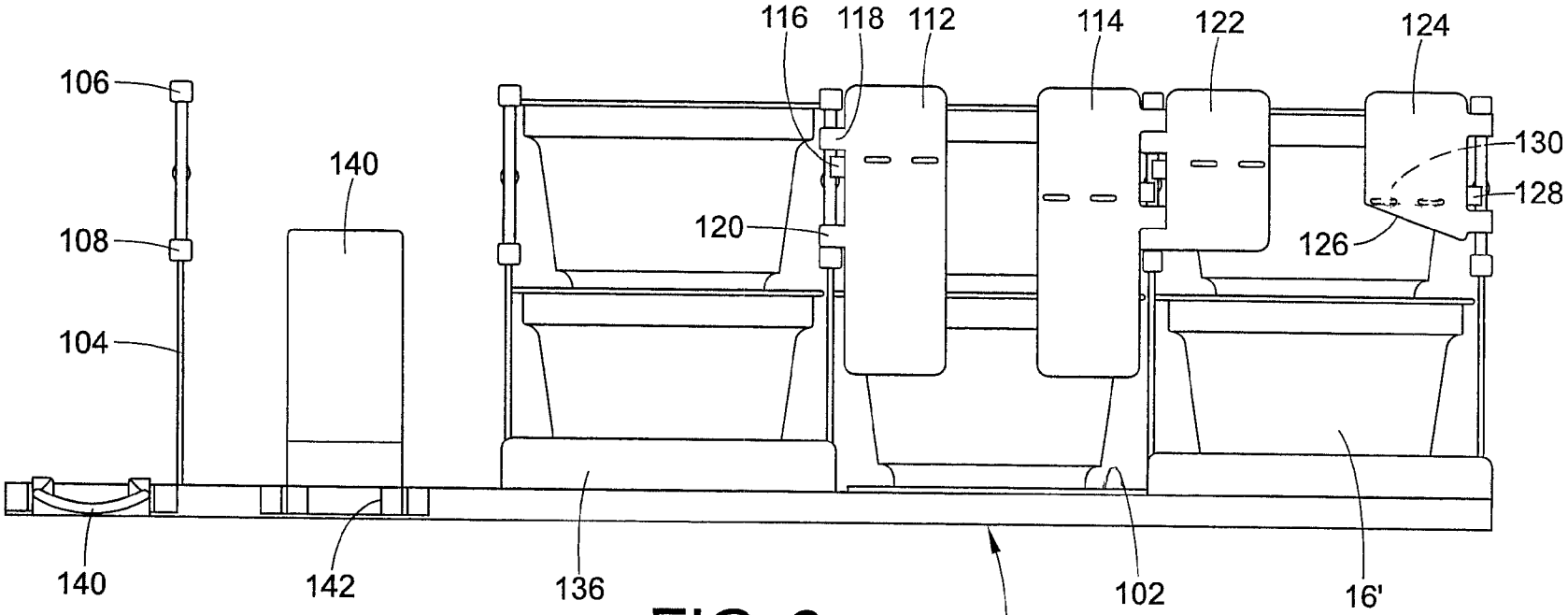
FIG. 6 is a front elevational view of a portion of a shelving system according to a third embodiment of the present disclosure.

With reference now to FIG. 6, another shelf 100 is there illustrated. The shelf includes a base 102 which supports a plurality of spaced dividers 104. In this embodiment, each divider includes a first protrusion 106 which can be located on the upper end of the divider and a second protrusion 108 which is spaced from the first protrusion. This embodiment employs barriers. More specifically, first and second barriers 112 and 114 are mounted to respective dividers. The barriers are spring loaded, such as by a spring 116, which can be a coil spring, to a neutral position. In order to mount the barriers to the dividers, the barriers are each provided with an upper arm 118 and a lower arm 120. These arms are connected to the dividers and positioned between the first and second protrusions 106 and 108 on the dividers. In their neutral orientation, the barriers serve to prevent further forward movement of containers 16' on the gravity fed shelf. In the embodiment illustrated in FIG. 6, the barriers can pivot forward and back in the same manner as café type doors or saloon doors. It should be appreciated that the first and second barriers 112 and 114 cooperate to retard the forward movement of a stacked set of containers 16'. In other words, multiple containers, one atop another, are prevented from moving forward by the cooperating barriers 112 and 114. Put another way, the height of the barriers 112 and 114 is greater than the height of a container 16'. In the design illustrated, the adjacent edges of the barriers or doors are spaced from one another, but they could be close to one another in the neutral position. The barriers can be made of a transparent material so that information on the container would be visible to purchasers.

In another design, the barrier can be so shaped as to only extend the height of a single container, such as the barrier 122. In still another design, a single product barrier, such as at 124, can include a tapered lower surface 126. This allows a consumer to more easily grasp the container 16' by allowing the fingers of the consumer to contact the container without blockage by the barrier. As with the earlier barrier designs, the barrier 124 is biased to a neutral position by a spring 128. The spring 128 can include a leg 130 illustrated in dashed outlines, which can extend along a back side of the barrier.

In still another design, a short front fence 136 can be employed to block further forward movement of a lowermost container 16'. In a yet further embodiment, a pivoting barrier 140, biased by a spring 142 to an upright position, is illustrated. To the far left of FIG. 6 is an illustration of the pivoting barrier 140 in a forwardly pivoted orientation, so as to allow removal of container 16' from the shelf 100.

Figure 7:
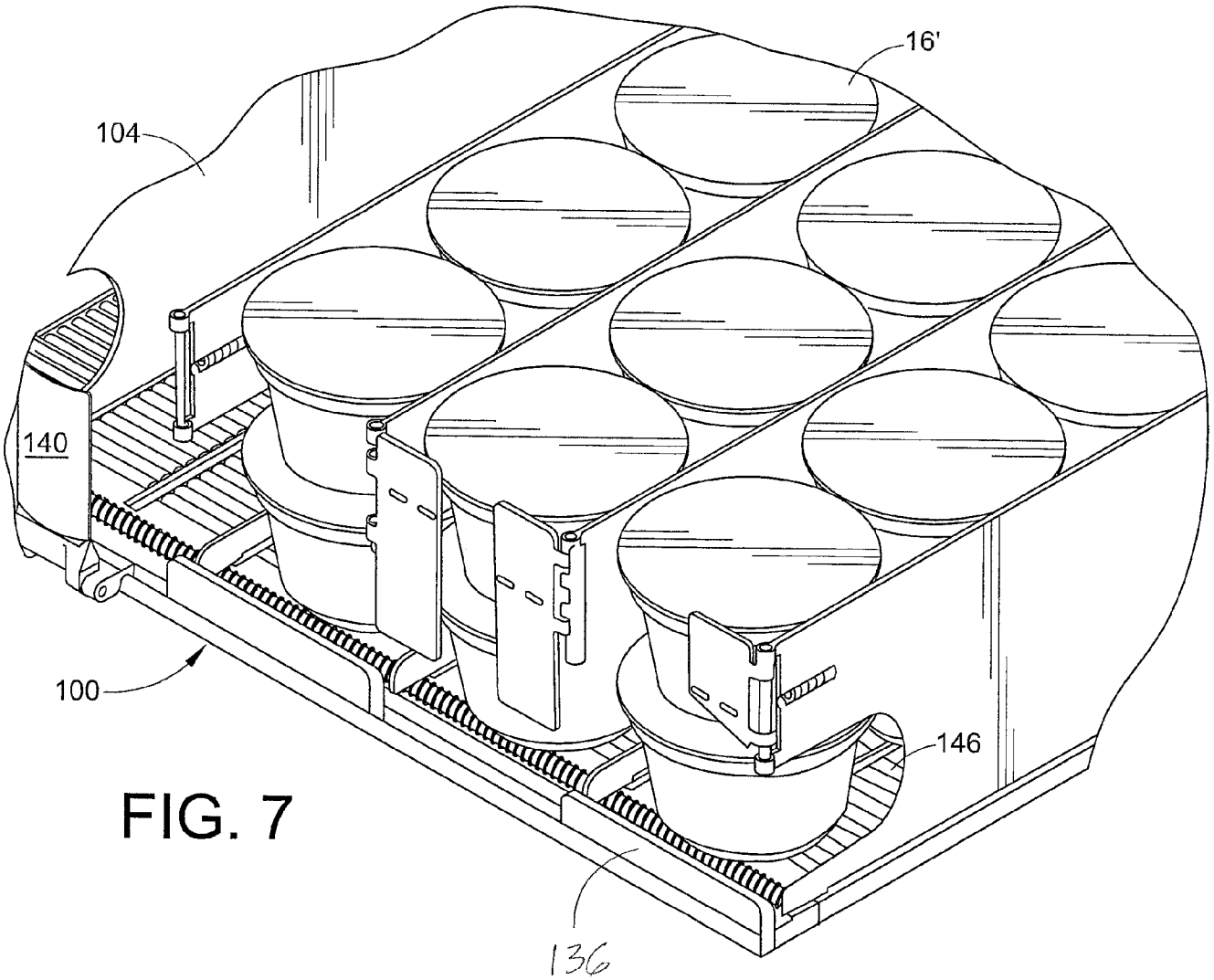
FIG. 7 is a perspective view of a portion of the shelving system of FIG. 6.

FIG. 7 illustrates that the divider 104 can include a slot 146 along its front face. The slot serves to accommodate the fingers of a consumer who wishes to withdraw a container 16' from the shelf 100. When barriers are employed only for an upper column of products, such as on the far right in FIG. 7, then a short front fence 136 becomes useful to retard a lower container 16' from falling off the shelf 100.

With reference now to FIG. 10, disclosed therein is a shelving design in which an auxiliary shelf 150 is mounted on a support shelf 160 that is connected to uprights or standards by a mounting portion 162 including teeth 164. It can be seen that the auxiliary shelf 150 is somewhat shorter than the main shelf 160. While less product can be held on the auxiliary shelf than on the main shelf, the auxiliary shelf is nevertheless advantageous from the standpoint that it can be easily connected to the main shelf or disconnected therefrom as may be necessary. In this way, a merchant can nest more product in the same amount of space without having to remove and reinstall all the shelving for a particular product category.

Figure 11:
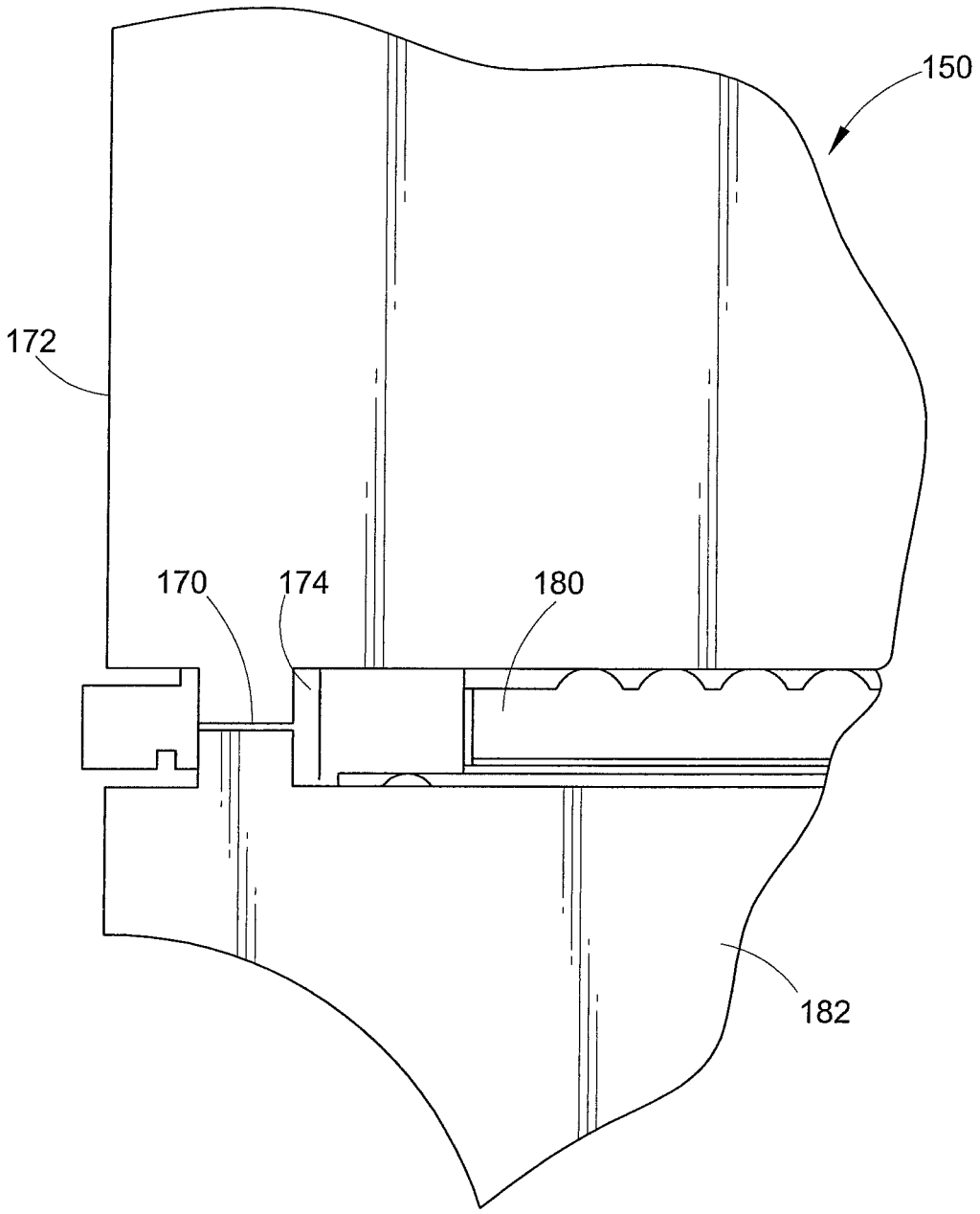
FIG. 11 is a schematic side elevational view of a portion of the shelving system of FIG. 10.

With reference now to FIG. 11, the auxiliary shelf 150 can be mounted via tabs 170 which protrude from a top divider 172. In one embodiment, such tabs extend into a slot 174 which can be provided in a housing of a roller system 180. The roller system can be of the same type as the roller track 14 discussed above. The slots can be provided on or adjacent to side edges of the roller system or roller track housing. Such slots can extend through the roller track housing so as to be accessible from both a top surface and a bottom surface of the track.

Figure 3:
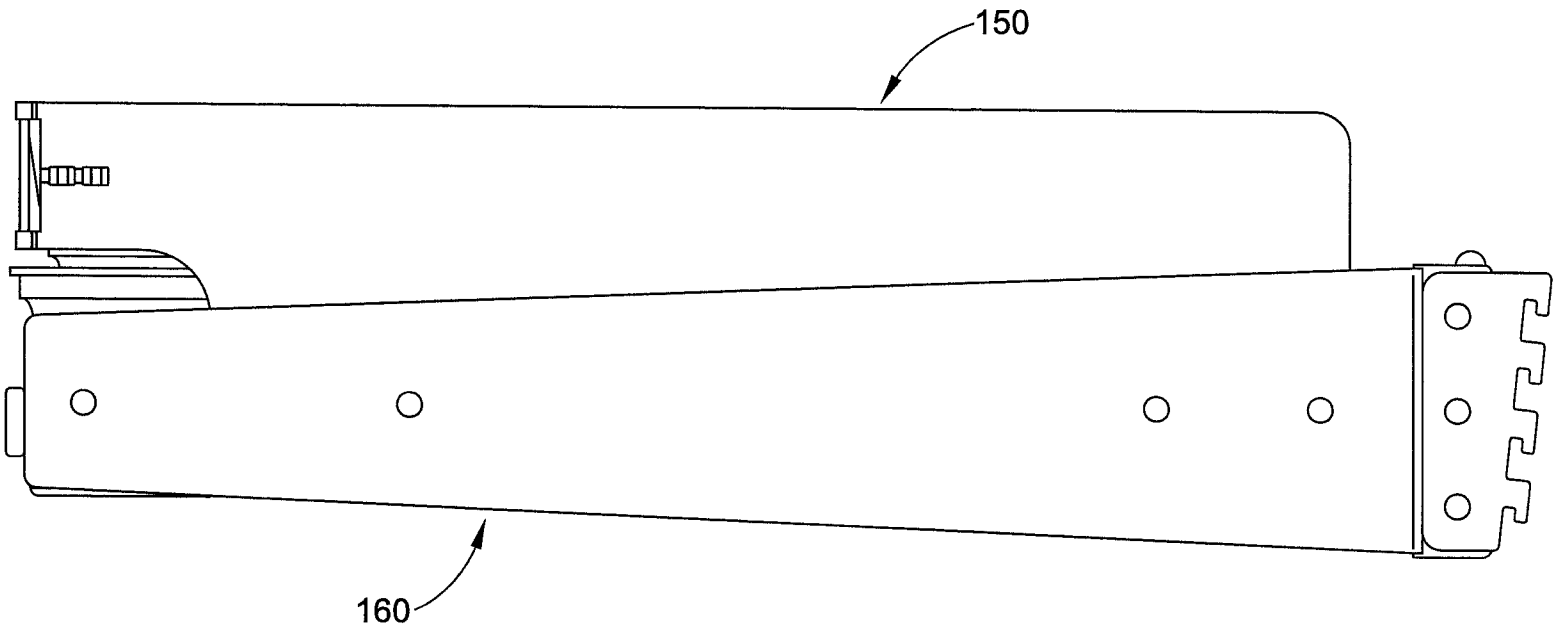
FIG. 3 is a side elevational view of a shelving system according to a second embodiment of the present disclosure in a retracted position.
Figure 4:
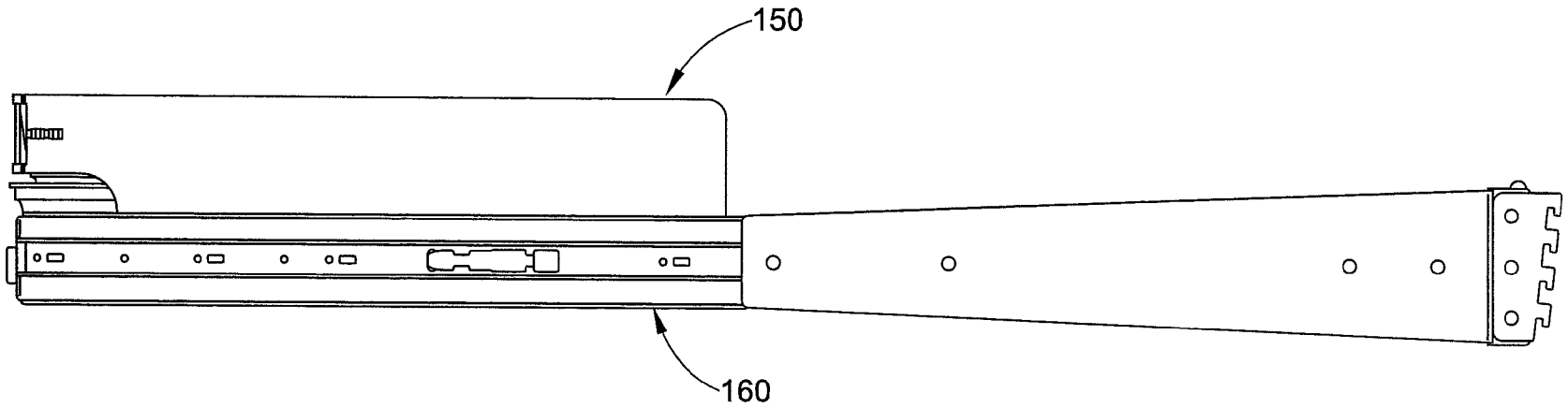
FIG. 4 is a side elevational view of the shelving system of FIG. 3 in an extended position.

The roller system 180 is mounted on a bottom divider 182, also having tabs, via the slots 174. Thus, the auxiliary shelf 150 is comprised of the roller system 180 and respective top dividers 172 located on either side of the roller system 180. One embodiment of this design is also evident from FIGS. 3 and 4.

Figure 13:
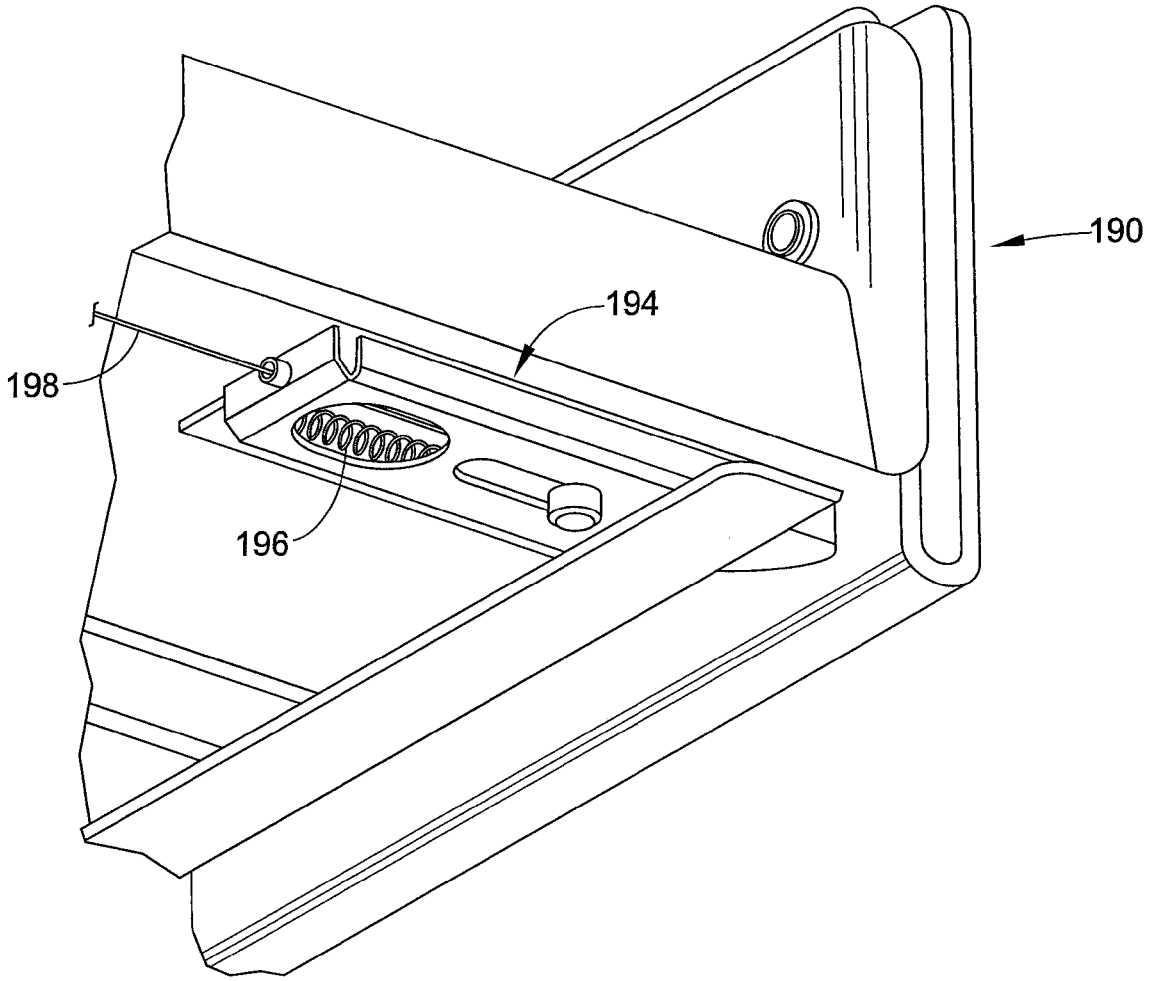
FIG. 13 is a perspective view of a latch system for shelving according to a further embodiment of the present disclosure.

With reference now to FIG. 13, a latch system can be provided for one or more of the types of shelving disclosed herein. In the embodiment illustrated in FIGS. 13-15, a shelf 190 is provided with a latch system 192 (FIG. 15). The latch system includes a latch member 194 which can be positioned adjacent both side edges of the shelf. The respective latch is located adjacent the shelf side wall. As evident from FIG. 13, the latch can be spring biased by a spring 196. It is evident from FIG. 15 that the two latch members 194 are connected via a cable 198 so that they act in unison unlatching the shelf at the same time.

Figure 14:
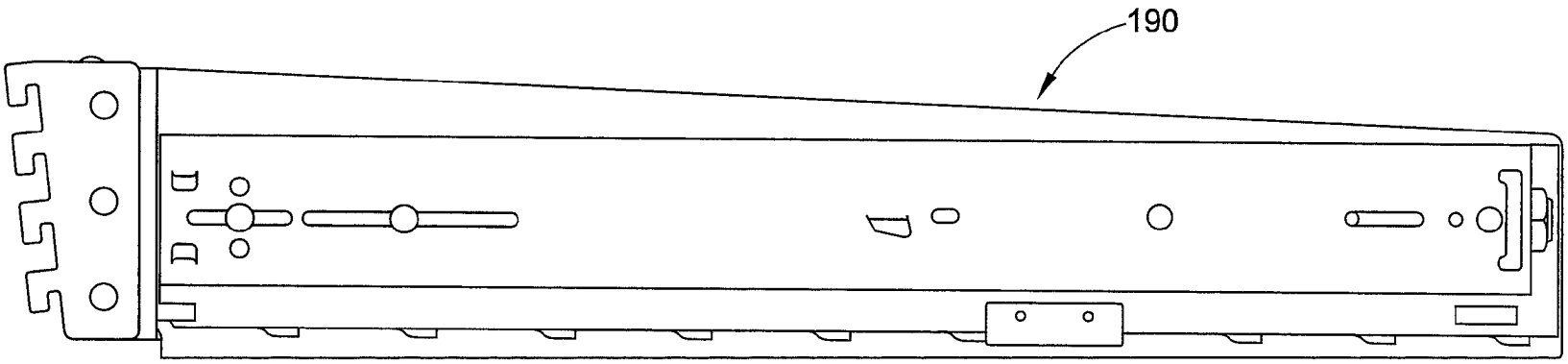
FIG. 14 is a side elevational view of the latch system of FIG. 13.
Figure 15:
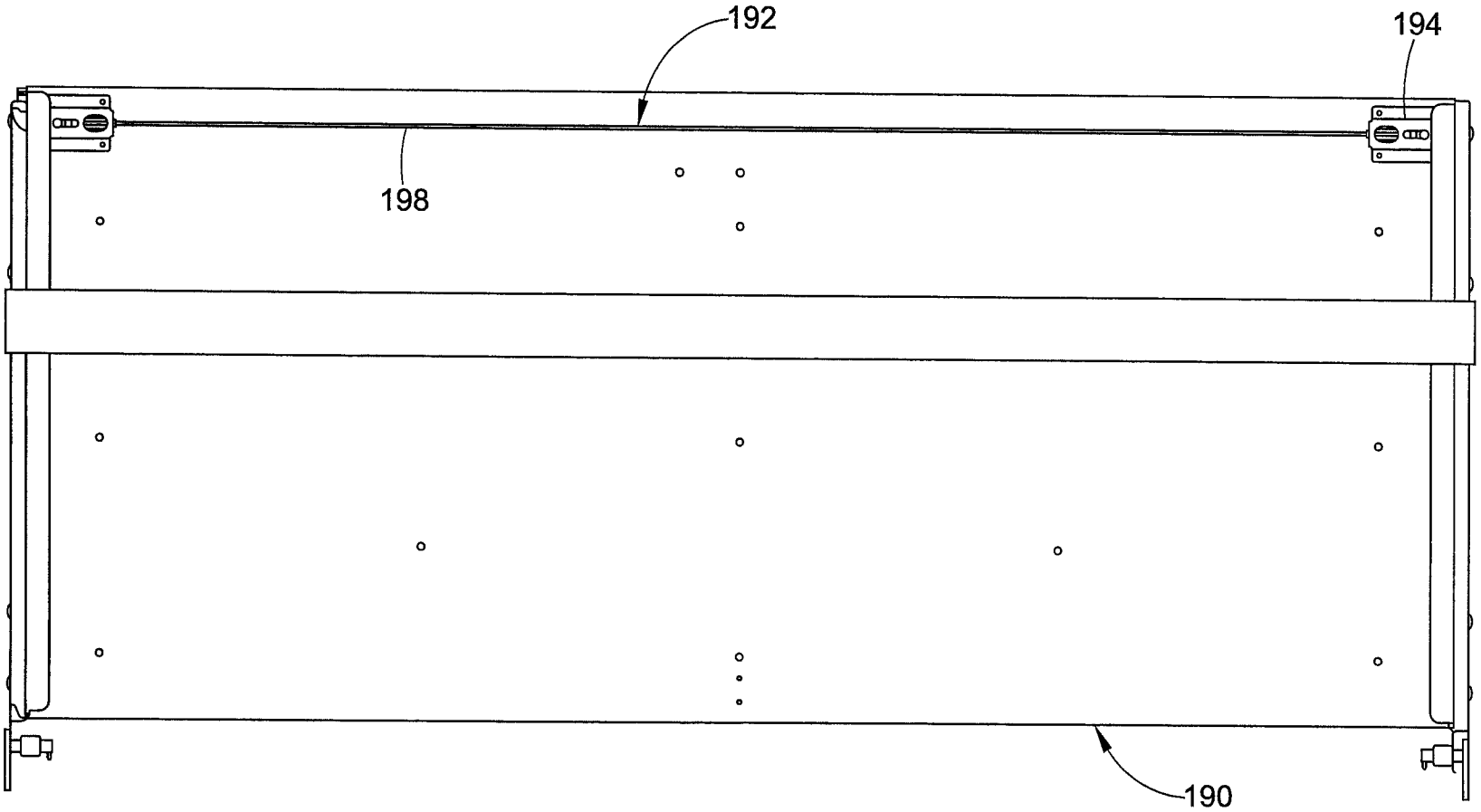
FIG. 15 is a bottom plan view of the latch system of FIG. 13.

With reference now to FIG. 14, the latch mechanism can be provided either adjacent the front end or the rear end of the shelf. It is contemplated that moving the latch towards the rear end of the shelf, i.e., towards the uprights, may be advantageous. An operator would hold the cable or the safety latch in order to slide the shelf forward to a product load configuration. The spring loaded safety latch would engage slots in the first and second brackets to allow the shelf to be slid out from a use configuration to a restocking configuration. When the shelf has been restocked, it is simply pushed back and the spring bias of the latches will again reengage the shelf with the brackets to maintain the shelf in a use configuration.

The product merchandiser embodiments illustrated herein allow shelving to be stacked closely together as withdrawal of the containers does not involve much upward movement of the containers to clear a barrier. Instead, the containers can be simply withdrawn in a generally horizontal direction. In addition, the provision of auxiliary shelves allows the product density for the merchant to be increased significantly. This is very desirable, as more products can be displayed by the merchant in the same amount of space without having to remove and reinstall shelves.

Further, the product merchandiser designs illustrated herein allow shelving to accommodate the uprights or standards of a variety of manufacturers, thereby enabling the disclosed shelving to be almost universal in nature.

In addition, another benefit of the disclosed shelving designs is that slide out shelving is provided in which the orientation of the shelf does not change during the sliding out procedure so that product held on the back end or inner end of the shelf does not hit or contact the shelf immediately above the one which is being slid forwardly.

A latch system is disclosed herein which enables the slide out shelf to be held in a use configuration. The latch system can be selectively disengaged to allow the shelf to move into a restocking configuration on slides defined between side walls of the shelf and brackets mounting the shelf to supports or uprights of the store fixtures.

A variety of blocking or retaining members has been disclosed herein for use at the front end or dispensing end of a gravity fed merchandising shelf. In one design, multiple stacked containers can be prevented from forward movement. In another design, single containers in a stack are prevented from such movement.

Disclosed has been a product vending system in the form of a merchandising shelf comprising a support member for supporting at least one associated object for display and/or dispensing. The support member defines a longitudinal pathway along which the associated at least one object can travel from a rear position to a front position. The shelving system can be of a slide out nature so that the shelf can be slid forward for restocking. The shelving system is adaptable for use with the uprights or standards supplied by a variety of manufacturers. Also, the shelving system, which can be a gravity fed system, can include a movable retainer operatively connected to a front end of the shelving system. The retainer is movable from a first position which at least partially obstructs the pathway, thereby retarding forward movement of the at least one associated object beyond the front end of the shelf, to a second position allowing further forward movement of the at least one associate object for removal of same from the shelf. In one embodiment, the retainer can include two cooperating sections which can pivot outwardly to allow product to be removed from the shelf or pivot inwardly to allow product to be restocked on the shelf. In another embodiment, the retainer assembly can retard the movement of at least two stacked containers at the same time. In one embodiment, a bottom wall of the retainers can be tapered so as to allow finger access to product being held on the shelf. A latching system for the pull out shelving is also provided.

The present disclosure has been described with reference to several embodiments. Obviously, modifications and alterations will occur to others upon the reading and understanding of the preceding detailed description. It is intended that the present disclosure be construed as including all such modifications and alterations insofar as they come within the scope of the appended claims or the equivalents thereof.

What is claimed is:

1. A shelf system comprising:

a support member that accommodates an associated object for display and dispensing, the support member including a front end and a rear end;

a mounting portion disposed adjacent the support member rear end, the mounting portion comprising:

a first member which connects to an associated upright, a second member which is operably connected to the support member, the second member comprising a wall section wherein the wall section is spaced inwardly from a side wall of the support member, a pin non-removably mounted to one of the first and second members, a sleeve non-removably mounted to the other one of the first and second members, wherein the sleeve selectively accommodates the pin, and a fastener for selectively securing the pin in the sleeve.

2. The system of claim 1 wherein the first member comprises a bracket including a planar body and at least one tooth projecting from the planar body.

3. The system of claim 2 wherein the pin is directly connected to the planar body.

4. The system of claim 3 wherein a plurality of spaced pins are directly connected to the planar body.

5. The system of claim 1 wherein the sleeve is directly mounted on the wall section.

6. The system of claim 5 wherein a plurality of spaced sleeve members are directly mounted on the wall section.

7. The shelf system of claim 1 further comprising a bracket on which the support member is mounted.

8. The system of claim 7 wherein the second member is connected to the bracket.

9. The system of claim 1 further comprising two side brackets on which the support member is slidably mounted.

10. A shelf system comprising:

a support member that accommodates an associated object for display and dispensing, the support member including a front end and a rear end;

a mounting portion disposed adjacent the support member rear end, the mounting portion comprising:

a first member which is adapted to connect to an associated upright, a second member which is adapted to operably connect to the support member, wherein the second member comprises a wall section which is spaced inwardly from a side wall of the support member, a pin non-removably held on the first member, the pin having a length and a diameter, a sleeve non-removably held on the second member, wherein the sleeve has a length shorter than the length of the pin and a diameter larger than the diameter of the pin so that the sleeve selectively accommodates the pin and allows a movement of the pin in relation to the sleeve thereby enabling an adjustment of a location of the first member in relation to a location of the second member, and a fastener adapted to selectively secure the pin in the sleeve.

11. The system of claim 10 wherein the first member comprises a bracket including a planar body and at least one tooth projecting from the planar body and wherein the pin is held on the planar body.

12. The system of claim 11 wherein a plurality of spaced pins are held on the planar body.

13. The system of claim 10 wherein the fastener comprises a cotter pin including a leg which selectively extends through an aperture located near a distal end of the pin.

14. A shelf system comprising:

a shelf which accommodates an associated object for display and dispensing, the shelf including a left side and a right side;

a left shelf bracket and a right shelf bracket, each including a planar main portion to which the respective left and right sides of the shelf are slidably mounted;

a left stanchion bracket located adjacent the left shelf bracket and adapted to connect to a first associated upright;

a right stanchion bracket located adjacent the right shelf bracket and adapted to connect to a second associated upright;

wherein a distal end of each of the left and right shelf brackets comprises an L-shaped construction including a first leg oriented perpendicular to a plane of the shelf bracket main portion and a second leg oriented parallel to the shelf bracket main portion, wherein a distance between the second legs of the left and right shelf brackets is less than a distance between the main portions of the left and right shelf brackets;

a first engaging member non-removably mounted to each of the second legs of each of the left and right shelf brackets; and, a second engaging member non-removably mounted to each of the left and right stanchion brackets, wherein the first and second engaging members engage each other to mount the shelf to the left and right stanchion brackets.

15. The shelf system of claim 14 wherein each of the stanchion brackets includes a planar body portion and a tooth extending away from the body portion.

16. The shelf system of claim 14 wherein the first engaging member comprises a pin and the second engaging member comprises a sleeve which accommodates the pin.

17. The shelf system of claim 14 further comprising a fastener adapted to selectively secure the first engaging member to the second engaging member.

* * * * *